US006142732A

United States Patent [19]

Chou et al.

[11] Patent Number: 6,142,732

[45] Date of Patent: Nov. 7, 2000

[54] FAN SCROLL

[75] Inventors: Shau-Tak R. Chou, Liverpool; Mark A. Daniels, Manlius, both of N.Y.

[73] Assignee: Carrier Corporation, Syracuse, N.Y.

[21] Appl. No.: 09/084,464

[22] Filed: May 26, 1998

[51] Int. Cl.[7] ..... F01D 1/02

[52] U.S. Cl. ..... 415/204; 415/203; 415/207; 415/119; 415/15

[58] Field of Search ..... 415/15, 26, 47, 415/119, 203, 204, 206, 207

[56] References Cited

U.S. PATENT DOCUMENTS 4,182,596 1/1980 Wellman ..... 415/207
4,450,755 5/1984 Catan ..... 98/36
5,141,397 8/1992 Sullivan ..... 415/206
5,156,524 10/1992 Forni ..... 415/182.1

*Primary Examiner*—Edward K. Look
*Assistant Examiner*—Matthew T. Shanley

[57] ABSTRACT

The angular extent of the flow path in a fan scroll is extended by reducing the rate of radial expansion of the flow path. By extending the angular as circumferential extent of the scroll flow path downstream of the fan impeller ANC structure can be located in/on the scroll while being located a sufficient distance downstream of the impeller. The flow path length can be increased without increasing the cubage of the scroll and, if desired, a further flow path increase can be achieved by a combination of the reduced rate of radial expansion together with increasing the cubage.

4 Claims, 2 Drawing Sheets

FAN SCROLL

BACKGROUND OF THE INVENTION

To control the noise from air handling units (AHUs), duct active noise control (ANC) systems are starting to be employed in air distribution systems. An ANC system basically requires the sensing of the noise associated with the fan for distributing air, producing a noise canceling signal and determining the results of the canceling signal so as to provide a correction signal to the loudspeaker. There is a time delay associated with sensing the noise and producing a canceling signal. This time delay necessary for the canceling to take place equates to the distance in the system required between the reference, or input, noise sensor and the loudspeaker. Additional space is required between the loudspeaker and the error sensor which also equates to a distance in the system.

A centrifugal fan discharges into a scroll which provides an expanding flow path for the air passing from the impeller into the scroll. The flow path, typically, is expanding radially but may also be expanding axially. It is common to characterize a fan by the angle of the slope of a plot of the variable scroll radius (R) vs the angular or circumferential extent ($r\theta$), where r is the radius of the fan and $\theta$ is the angular extent). In conventional designs, the annular extent of the flow path is less than 360°, with 300° being typical. The reasons for this angular extent is the diffusing of the air flow as well as minimizing the space and material needed to make the scroll.

SUMMARY OF THE INVENTION

The angular extent of a fan scroll flow path which is a radius vector from the fan hub to the scroll such that the radius vector is essentially perpendicular to the flow leaving the fan housing is extended beyond 360° by reducing the rate of radial expansion of the flow path. It will be noted that the increased angular extent of the scroll flow path is in the portion having the greatest radius. At a radius of two feet, a 30° angular or circumferential extent ($r\theta$) corresponds to approximately one foot. By extending the angular or circumferential extent of the scroll flow path downstream of the fan impeller and reducing the rate of expansion, the flow path length can be increased without increasing the size or cubage of the scroll or with a minimal increase thereof. Additionally, length can be added within the scroll portion of the flow path by enlarging the size or cubage of the scroll. The significance of the increased flow path length is that it permits locating the ANC structure wholly within the extent of the scroll while being located a sufficient distance downstream of the impeller to avoid significant flow noise.

It is an object of this invention to integrate an active noise cancellation system into an air handler unit.

It is another object of this invention to reduce the size impact of active noise control devices by better integration of active noise control systems with blowers.

It is a further object of this invention to increase the flow path length within a fan scroll. These objects, and others as will become apparent hereinafter, are accomplished by the present invention.

Basically, the rate of expansion within a fan scroll is reduced such that a longer flow path within the scroll is necessary to achieve the desired expansion. The increased flow path length permits the integration of an ANC system with the air handler.

For a fuller understanding of the present invention, reference should now be made to the following detailed description thereof taken in conjunction with the accompanying drawings wherein.

DESCRIPTION OF THE PREFERRED EMBODIMENT

Figure 1:
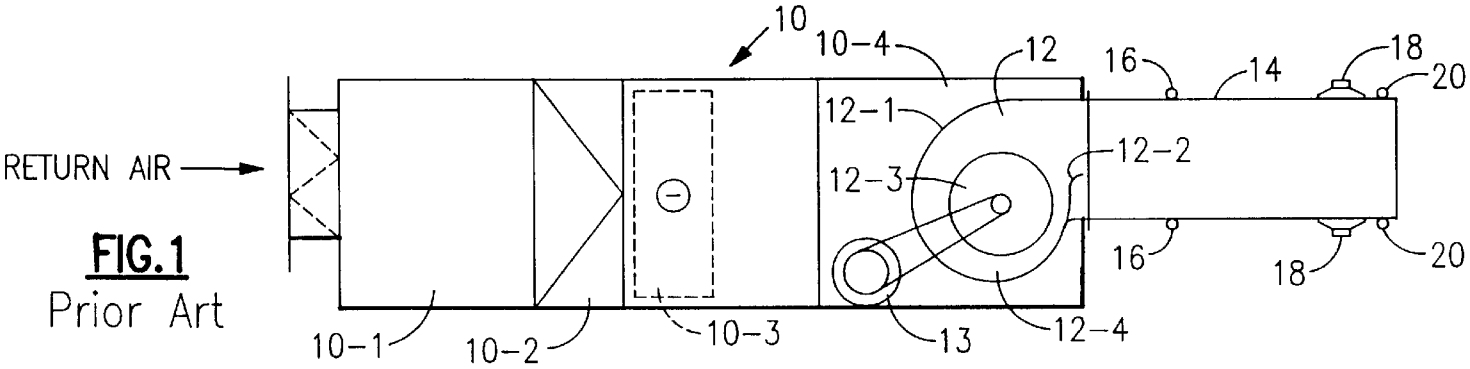
FIG.1 Prior Art
FIG. 1 is a PRIOR ART air handler unit with a conventional duct ANC system.

In FIG. 1, the numeral 10 generally designates a conventional AHU with conventional duct ANC structure located in duct 14 which is connected to the discharge of fan 12. The AHU 10 is typically made up of a plurality of sections and/or subassemblies including mixing box 10-1, filter 10-2, coil 10-3 and fan housing 10-4. Fan 12 has a cutoff 12-2 which defines the actual outlet from scroll 12-1 but, as is conventional, the outlet defined at the cutoff discharges into the larger duct 14. For maximum performance, expansion of the flow is allowed to take place in the duct 14 for a distance equal to three times the diameter of blower 12-3. In that distance the turbulence associated with the fan discharge diminishes along with the associated difficulties with locating sensing microphones 16 in a region where considerable flow generated noise is present. A typical duct ANC system for large air distribution systems can require a ten foot spacing to accommodate the input noise sensing microphones(s) 16, the noise canceling speaker(s) 18 and the error sensing microphone(s) 20.

In operation, blower 12-3 is driven by motor 13 thereby drawing return and makeup air into the AHU 10, through a heat exchanger defined by coil 10-3 to heat or cool the air and delivering the resultant conditioned air from scroll 12-1 into duct 14. The fan noises are sensed by microphone(s) 16 and through circuitry (not illustrated), speaker(s) 18 is (are) driven to produce a signal to cancel the fan noise. Microphone(s) 20 sense the result of the noise cancellation by speaker(s) 18 and through circuitry (not illustrated) the output of speaker(s) 18 is corrected such that sound energy is minimized at microphone(s) 20.

Figure 2:
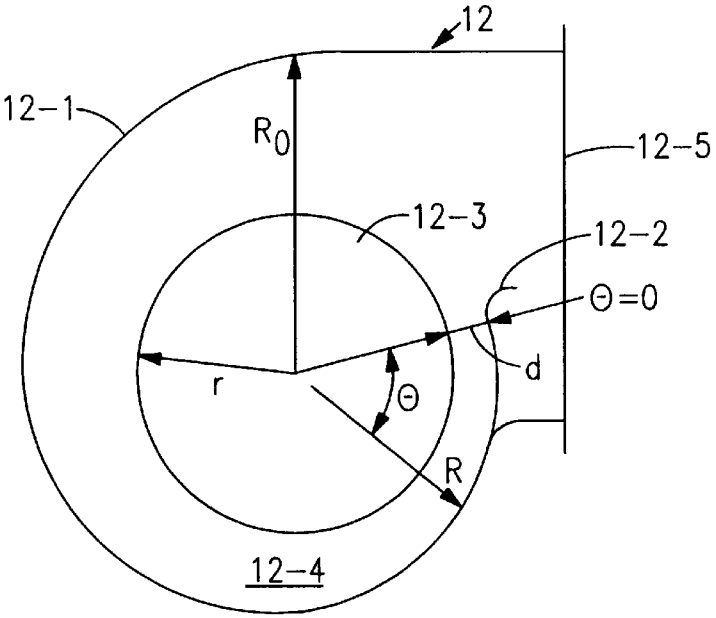
FIG.2 Prior Art
FIG. 2 is a view of a PRIOR ART fan scroll for the air handler unit of FIG. 1.

Referring specifically to FIG. 2, as illustrated, the air is discharged from clockwise rotating blower 12-3 into the space 12-4 between blower 12-3 and scroll 12-1. The space 12-4 is of increasing cross sectional area in a clockwise direction such that the air is permitted to expand as it travels along space 12-4 towards the fan outlet 12-5. With cutoff 12-2 defining one end of the space 12-4 it will be noted that space 12-4 is less than 360° in extent. Blower 12-3 has a radius r and is spaced from cutoff 12-2 a distance d such that the radius, R, of scroll 12-1 is r+d at cutoff 12-2. The angular extent, $\theta$, of scroll 12-1 is measured clockwise, as viewed in FIG. 2, from cutoff 122 and, typically, is on the order of 300°. The radius R and space 12-4 increase with $\theta$ in going clockwise from cutoff 12-2 towards to its maximum value $R_o$ at the fan discharge.

Figure 3:
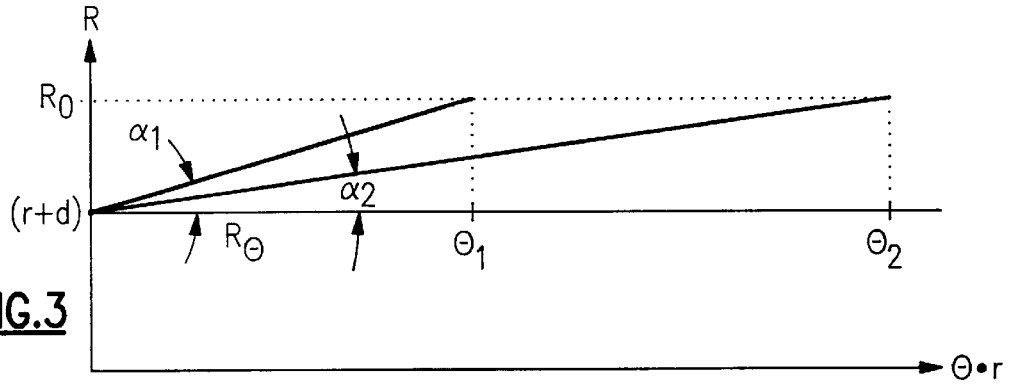
FIG. 3 is a graphical representation of the relationship between the scroll radius and the angular extent of the scroll for conventional $\alpha_1$ and the present invention's $\alpha_2$ scroll-expansion angles.

Referring to FIG. 3, r+d represents the radius R of scroll 12-1 at cutoff 12-2 or the radius of scroll 112-1 at cutoff 112-2. Angle $\alpha_1$ represents the expansion angle for scroll

12-1 and radius R reaches its maximum value, $R_o$, at $R_o=(r+d)+r\theta_2 \tan \alpha_1$. A typical value of $\theta_1$ would be 300°. According to the teachings of the present invention, expansion angle $\alpha_1$, is reduced to $\alpha_2$ and, accordingly, $R_o=(r+d)+r\theta_2 \tan \alpha_2$. A typical value of $\theta_2$ would be 450° which would represent approximately a five foot increase of $r\theta_2$ relative to $r\theta_1$ for a two foot radius. A typical value of $\alpha_2$ would be from 4° to 10°. Note that while a scroll with a linear expansion is used for purposes of illustration, other expansions can be used.

Figure 4:
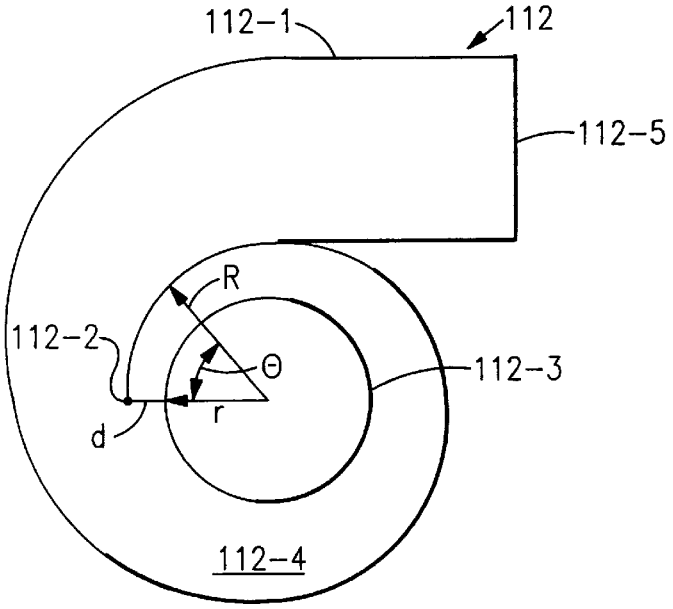
FIG. 4 is a view of the fan scroll of the present invention.
Figure 5:
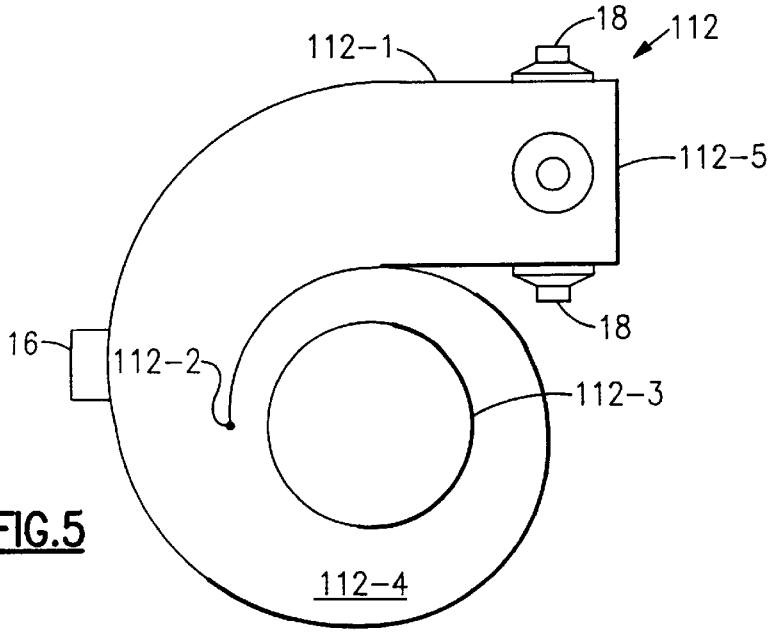
FIG. 5 is a view of the fan scroll of FIG. 4 modified to include structure of a duct ANC system.

In FIGS. 4 and 5, the numeral 112 designates the modified fan of the present invention. In fan 112, as compared to fan 12, the cutoff has been effectively shifted counterclockwise such that the rate of radial expansion, $\alpha_2$, of space 112-4 is less than the corresponding rate of radial expansion, $\alpha_1$, of space 12-4. Additionally, the angular extent θ from the point of closest proximity between blower 112-3 and cutoff 112-2 and the outlet 112-5 is, as illustrated, on the order of 180° greater than that for fan 12 i.e. θ is at least 400° but, preferably on the order of 480°. The present invention uses the increased circumferential extent to locate the ANC structure which is then sufficiently far along the flow path in the scroll 112-1. As noted above, the slow rate of expansion in scroll 112-1 as compared to scroll 12-1 provides a longer flow path within the same cubage. If the cubage is increased in combination with the slow rate of expansion, the flow path length can be further increased. Because the increased length is in the nature of a spiral, the portion of the flow path beyond 360° is radially separated from the upstream portion of the flow path rather than being axially separated. Accordingly, all or portions of the scroll flow path may be provided with an acoustic damping liner.

Referring specifically to FIG. 5, it will be noted that sensing microphone(s) 16 is (are) located at a location, nominally, 360° along the flow path such that they are ahead of or directly opposite the fan cutoff 12-2. Sensing microphone(s) 16 can be located further upstream, e.g. 300° along the flow path since angular extent is only one component of the parameters dictating flow path length. Speakers 18 are located downstream of microphone(s) 16, as illustrated, nominally, 120° further along the flow path. Since the microphone 16 location can be varied, speakers 18 may also be moved upstream with 400° along the flow path being at the lower acceptable range. At a nominal two foot diameter the 120° translates into about four feet downstream of the microphone(s) 16. Microphone(s) 20 can be located downstream of the blower 112-3 in the duct (not illustrated) such that they are in the same plane or downstream of loudspeaker(s) 18. If necessary, or desired, the speaker(s) 18 can be located in the duct (not illustrated) while taking advantage of the space saving features associated with locating microphone(s) 16 in or on scroll 112-1.

Although a preferred embodiment of the present invention has been described and illustrated, other changes will occur to those skilled in the art. It is therefore intended that the scope of the present invention is to be limited only by the scope of the appended claims.

What is claimed is:

1. A fan having a housing;

said housing having an outlet;

a blower located in said housing;

said housing having a radially increasing section surrounding said blower and defining a flow path therewith;

a cutoff located in said housing and coacting with said blower to define the closest radial separation between said blower and any surrounding structure;

a flow path defined between said blower and said radially increasing section starting at said cutoff and extending for at least 360° starting from said cutoff;

means for sensing noise located at a location at least 300° along said flow path; and means for producing a noise canceling signal at a location at least 360° along said flow path.

2. The fan of claim 1 wherein said flow path is over 450° in extent.

3. A fan having a housing;

said housing having an outlet;

a blower located in said housing;

said housing having a radially increasing section surrounding said blower and defining a flow path therewith;

a cutoff located in said housing and coacting with said blower to define the closest radial separation between said blower and any surrounding structure;

a flow path defined between said blower and said radially increasing section starting at said cutoff and extending for at least 360° starting from said cutoff;

means for sensing noise located nominally opposite of said cutoff; and means for producing a noise canceling signal at a location at least 360° along said flow path.

4. The fan of claim 3 wherein said flow path is over 450° in extent.

* * * * *